United States Patent [19]

Pujol

[11] 4,024,919

[45] May 24, 1977

[54] TECHNIQUE FOR INSULATING A WELLBORE WITH SILICATE FOAM

[75] Inventor: Luis Pujol, Houston, Tex.

[73] Assignee: Exxon Production Research Company, Houston, Tex.

[22] Filed: June 16, 1976

[21] Appl. No.: 696,604

[52] U.S. Cl. ..... 166/303; 166/57

[51] Int. Cl.[2] ..... E21B 43/24

[58] Field of Search ..... 166/272, 302, 303, 309, 166/57, DIG. 1

[56] References Cited

UNITED STATES PATENTS

| | | | |
|---|---|---|---|
| 3,525,399 | 8/1970 | Bayless et al. | 166/303 |
| 3,664,424 | 5/1972 | Penberthy, Jr. et al. | 166/303 |
| 3,664,425 | 5/1972 | Penberthy, Jr. et al. | 166/303 |
| 3,861,469 | 1/1975 | Bayless et al. | 166/303 |

OTHER PUBLICATIONS

Leutwyler et al., "Temperature Effects on Subsurface Equipment in Steam Insection Systems", Journal of Petroleum Technology, 1/1965, pp. 93–101.

*Primary Examiner*—Stephen J. Novosad
*Assistant Examiner*—George A. Suchfield
*Attorney, Agent, or Firm*—Gary D. Lawson

[57] ABSTRACT

Disclosed herein is a method for thermally insulating a well. The well is insulated by boiling a solution containing silicate in contact with well tubing to form a coating of silicate on the tubing. A fluid substantially free of silicate also contacts the well tubing to buffer a lower portion of the tubing from the silicate solution. This substantially silicate-free fluid prevents silicate foam coating on the lower portion of the tubing and thus alleviates problems associated with having silicate foam coated thereon.

12 Claims, 2 Drawing Figures

TECHNIQUE FOR INSULATING A WELLBORE WITH SILICATE FOAM

BACKGROUND OF THE INVENTION

1. Field of the Invention

This invention relates to a process for thermally insulating a well. More specifically, the invention relates to a process for insulating an upper portion of a tubing string in a wellbore with silicate foam and leaving a lower portion of the tubing string uninsulated.

2. Description of the Prior Art

In the recovery of heavy petroleum crude oils, the industry has for many years recognized the desirability of thermal stimulation as a means for lowering the oil viscosity and thereby increasing the production of oil.

One form of thermal stimulation which has recently received wide acceptance by the industry is a process of injecting steam into the well and into the reservoir. This process is a thermal drive technique where steam is injected into one well and the steam drives oil before it to a second, producing well. In an alternative method, a single well is used for both steam injection and production of the oil. The steam is injected through the tubing and into the formation. Injection is then interrupted, and the well is permitted to heat soak for a period of time. Following the heat soak, the well is placed on a production cycle, and the heat fluids are withdrawn by way of the well to the surface.

Steam injection can increase oil production through a number of mechanisms. The viscosity of most oils is strongly dependent upon its temperature. In many cases, the viscosity of the reservoir oil can be reduced by 100 fold or more if the temperature of the oil is increased several hundred degrees. Steam injection can have substantial benefits in recovering even relatively light, low-viscosity oil. This is particularly true where such oils exist in thick, low permeability sands where present fracturing techniques are not effective. In such cases, a reduction in viscosity of the reservoir oil can sharply increase productivity. Steam injection is also useful in removing wellbore damage at injection and producing wells. Such damage is often attributable to asphaltic or paraffinic components of the crude oil which clog the pore spaces of the reservoir sand in the immediate vicinity of the well. Steam injection can be used to remove these deposits from the wellbore.

Injection of high temperature steam which may be 650° F. or even higher does, however, present some special operational problems. When the steam is injected through the tubing, there may be substantial transfer of heat across the annular space to the well casing. When the well casing is firmly cemented into the wellbore, as it generally is, the thermally induced stresses may result in casing failure. Moreover, the primary object of any steam injection process is to transfer the thermal energy from the surface of the earth to the oil-bearing formation. Where significant quantities of thermal energy are lost as the steam travels through the tubing string, the process is naturally less efficient. On even a shallow well, the thermal losses from the steam during its travel down the tubing may be so high that the initially high-temperature, superheated or saturated steam will condense into hot water before reaching the formation. Such condensation represents a tremendous loss in the amount of thermal energy that the injected fluid is able to carry into the reservoir.

A number of proposals have been advanced to combat excessive heat losses and to reduce casing temperatures in steam injection processes. It has been suggested that a temperature resistant, thermal packer be employed to isolate the annular space between the casing and injection tubing. Such equipment will reduce heat transfer due to convection between the tubing string and the casing string by forming a closed, dead-gas space in the annulus. Such specialized equipment is not only highly expensive, but does nothing to prevent radiant thermal transfer from the injection tubing.

It has been suggested that the wells be completed with a bitumastic coating. This completion technique utilizes a material to coat the casing which will melt at high temperature. When melting occurs, the casing is free to expand thus preventing the stresses which would otherwise be placed on the casing due to an increase in its temperature. This method has not proven to be universally successful in preventing casing failure. In some instances the formation may contact the casing with sufficient force to prevent free expansion and contraction of the casing during heating and cooling. Under these circumstances casing failure is possible due to the unrelieved stresses. Moreover, such a completion technique does nothing to prevent the loss of thermal energy from injection tubing.

It has been suggested that an inert gas, such as nitrogen, be introduced into the annular space between the casing and tubing and pumped down the annulus to the formation. This method requires, however, a source of gas, means for pumping the gas down the annulus, and means for separating the inert gas from the produced well fluids.

Another means which has been successfuuly employed to lower heat transfer from team injection tubing is the heat reflector system. This is a shell of heat reflective, metal pipe which surrounds the tubing string. It is assembled in joints which are equal in length to the joints of the tubing and run into the hole with the tubing string as an integrated unit. The outer shell may be sealed at the top and bottom to prevent the entry of well fluids into the space between the steam injection tubing and the heat reflective shell. Such a system has utility in preventing the transfer of thermal energy from injection tubing due to radiation, conduction, and convection. Such a system, of course, is relatively expensive since it requires two strings of metallic pipe——the injection tubing and the heat reflective shell. Moreover, the use of the heat reflective shell will reduce the diameter of the tubing which may be effectively employed in any given well. This can be particularly important where multiple strings of tubing are employed in a single well.

A more recent technique involves the in situ formation of silicate foam on a tubing string (see, for example, U.S. Pat. No. 3,525,399 issued Aug. 25, 1970 and U.S. Pat. No. 3,718,184 issued Feb. 27, 1973 to Bayless And Penberthy). In this process the tubing string and packer are run into the well and set into place. Then an aqueous solution of water-soluble silicate is introduced into the casing-tubing annulus above the packer. Steam is injected into the tubing string to boil the silicate solution above its boiling point and to deposit a coating of alkali metal silicate foam on the tubing.

While this technique has had very good success, it does present some operational problems. Generally, all of the excess silicate solution is not removed from the annulus by boiling during the insulating process. When the level of the solution in the annulus drops and the boiling point of the solution increases due to loss of solution water, the discharge of excess silicate solution becomes less vigorous and eventually dies. If the remaining solution is left in the annulus after steam injection is terminated, it will tend to solidify into porous and permeable mass above the packer. When subsequent operations necessitate removal of the tubing and packer from the well, the mass of silicate foam above the packer may hinder this removal. It has, therefore, generally been the practice to employ some means for removal of this excess solution after the insulation has formed on the tubing.

While it has been suggested that this excess liquid may be removed from the annular space by employing a reverse circulating device in the tubing and displacing the remaining solution from the annular space, it has been found that this displacement is at times difficult to accomplish. The remaining liquid may be highly viscous and cannot be effectively displaced with a gaseous displacing agent such as natural gas. Nor is water a totally satisfactory displacing agent. Although the dehydrated coating is not instantly soluble in water, it will deteriorate and dissolve when contacted by water for an extended period. Also, the length of time that the coating can resist deterioration by water is reduced by the relatively high temperature existing in the well following boiling of the silicate solution. Since a number of hours would be required to remove a fresh water displacing fluid from the annulus of a deep well, the use of water as a displacing fluid may cause deterioration of the silicate coating.

Other methods have recently been suggested to deal with the problem of excess solution remaining in the lower portion of the annulus after the insulation has formed on the tubing. In one method, as proposed in U.S. Pat. No. 3,664,425 issued May 23, 1972 to Penberthy et al, a foaming agent is incorporated in the silicate solution to assist in discharging more liquid during the boiling operations. In another method, as proposed in U.S. Pat. No. 3,664,424 issued May 23, 1972 to Penberthy et al, excess alkali metal silicate solution is displaced from the tubing well annular space by a fluid having a low solubility for the silicate coating. In still another method, as proposed in U.S. Pat. No. 3,861,469 issued Jan. 21, 1975 to Bayless et al, steam is injected into the tubing string until the excess silicate solution in the annular space forms a porous, permeable, and water-soluble mass. The porous and permeable mass can then be dissolved with water when it is desired to remove the tubing and packer from the well. These techniques are only partially effective and can, in certain instances, increase the cost of the process. All of these methods suggest removing excess silicate solution after the insulation has formed.

SUMMARY OF THE INVENTION

In the practice of this invention, an aqueous solution containing silicate is introduced into the annulus of a well between the tubing string and the casing string. A substantially silicate-free fluid is introduced into the annulus to buffer a portion of th tubing from the silicate solution. Thermal energy is then introduced into the tubing to boil the silicate solution and to deposit a coating of silicate foam on the exterior of the tubing string. During the period that the silicate solution is boiling, the annulus is vented to the atmosphere to discharge water vapor. As the silicate is deposited on the tubing, the buffer fluid should be disposed in the lower portion of the annulus to prevent silicate coating on the lower portion of the tubing. To assure that the buffer fluid is in the lower portion of the annulus, it is preferred that the buffer fluid have a higher density than the silicate solution. It is further preferred that the buffer fluid have a higher boiling point than the silicate solution.

The presence of the buffer fluid in the lower portion of the annular space alleviates problems associated with having silicate foam adjacent the packer.

Objects of the invention not apparent from the above discussion will become evident upon consideration of the following description of the invention taken in connection with the accompanying drawings.

DESCRIPTION OF THE INVENTION

Figure 1:
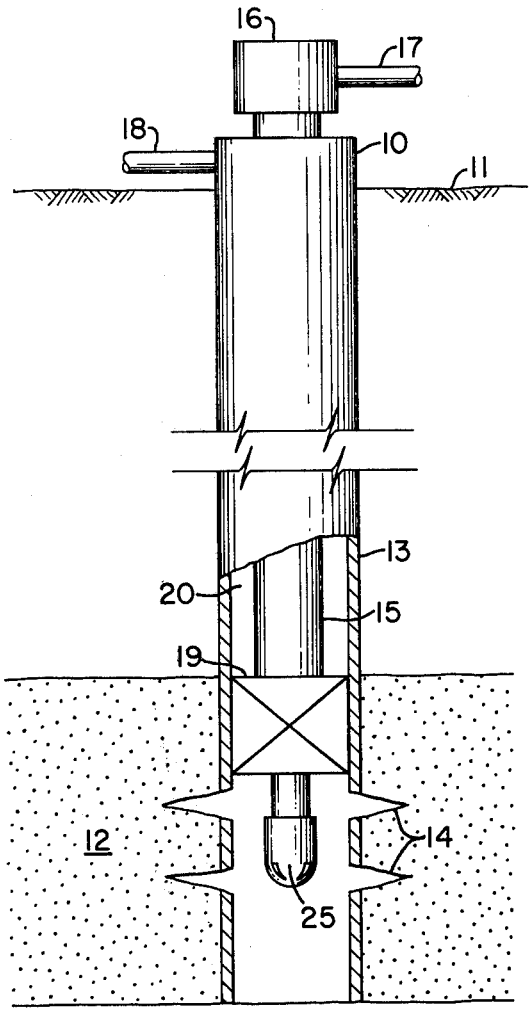
FIG. 1 is a schematic representation of a vertical section of the earth showing a well containing casing and steam injection tubing.
Figure 2:
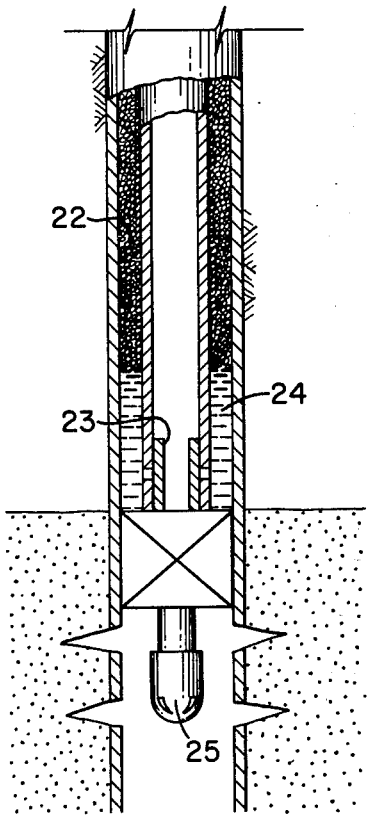
FIG. 2 is a schematic representation of the well after introduction of the silicate solution and displacement by a suitable displacing liquid.

In the embodiment shown in FIG. 1, a well shown generally at 10 is drilled from the surface of the earth 11 to an oil-bearing formation 12. The well has a casing string 13 with perforations 14 in the oil-bearing formation to permit fluid communication between the oil-bearing formation and the casing. Steam injection tubing 15 extends from the wellhead 16 to the oil-bearing formation. The tubing string is equipped with an inlet line 17 and the casing has an inlet line 18. A suitable packer 19 is set on the tubing string and run into the well to seal the annular space 20 between the tubing string and casing at a location above the oil-bearing formation. The lower portion of the tubing string will extend below the packer and will have an opening which will permit the flow of fluids between the tubing string and the oil-bearing formation. A landing nipple 25 is provided in the tubing string near its lower end which provides a seat for a blanking plug (not shown). Such a blanking plug is a conventional device which can be installed at the landing nipple to block fluid flow between the interior of the tubing and the oil-bearing formation and which can be removed by conventional wireline methods to reestablish such fluid communication. The tubing is also equipped with reverse circulation means 23 for establishing fluid communication between the interior of the tubing and the tubing-casing annulus 20 at a location above the packer assembly and above the landing nipple. A wireline actuated gas lift mandrel or sliding sleeve may be used for such a purpose.

In the practice of this invention an aqueous solution of a watersoluble silicate 22 is introduced into the casing-tubing annular space 20. This solution may be introduced into the annulus by injection through the flow line 18 in fluid communication with the annulus at the wellhead. It is preferred, however, to inject the solution down the tubing 15, through the gas-lift mandrel, and up the tubing-casing annulus 20. During this injection operation, the blanking plug is seated in the landing nipple to prevent flow of the solution out of the bottom of the tubing, the gas-lift mandrel is open to fluid flow, and the wellhead flow line to the annulus is opened to vent fluids displaced by the solution.

A substantially silicate-free fluid 24 which will be referred to herein as a buffer fluid is also introduced into the casing-tubing annular space 20. This buffer fluid may be introduced directly into the annulus by injection through the flow line 18 which is in communication with the annulus at the wellhead or it may be injected down the tubing 15 and through the gas-lift mandrel 23 into the annulus 20. In the practice of this invention, the buffer fluid may be introduced into the annular space before, during, or after introduction of the silicate solution into the annular space. It is preferred however, to inject the buffer fluid down the tubing, through the gas-lift mandrel, and up the tubing-casing annulus after the silicate solution has been injected into the annulus. A substantial portion of the buffer fluid should be in the lower portion of the annular space with the silicate solution in the upper portion. A sufficient volume of this buffer fluid should be injected into the annular space to fill the annular space to a significant distance above the packer, preferably to the bottom of the lowermost gas-lift mandrel. The total injected volume of the silicate solution and the buffer fluid should be sufficient to fill the annular space.

Following placement of the silicate solution and the buffer fluid in the annulus, a blind valve is installed in the gas-lift mandrel and the blanking plug is removed from the landing nipple. Thus, fluid flow between the tubing and annulus is blocked and fluid flow between the tubing and the oil-bearing formation is established. Steam is then introduced in the tubing at the wellhead through flow line 17, through the tubing string, and into the oil-bearing formation at the perforations in the casing. The casing inlet 18 on the annular flow line at the wellhead is open to vent the annular space. It is preferred to inject steam at a relatively high temperature, approximately 600° F., and a relatively high mass flow rate. The high temperature and high mass flow rate will permit rapid heating of the tubing string and will rapidly remove water from the silicate solution.

The steam passing down the tubing will heat the solution in the annulus and cause it to boil near the tubing. This boiling will cause a deposition of a coating of open cell alkali metal silicate or silicate foam on the surface of the tubing. During this heating and boiling operation steam and a foam of steam and silicate solution will be discharged from the annulus by way of the vent line 18 at the wellhead. The discharge through line 18 may also include buffer fluid if the thermal energy heats the buffer fluid above its boiling point. After a period of boiling, no appreciable quantity of silicate solution will be discharged through the vent line, and a substantial quantity of buffer fluid should remain in annular space 20 above packer 19. The quantity of buffer fluid to be injected into the annulus will depend on the tubing surface area to be buffered from the silicate solution. Of course, if the buffer fluid boils during the heating operation, the anticipated discharge of buffer fluid from the annular space during the heating operation should be taken into account in determining the quantity of buffer fluid to be injected into the annular space. To help assure that some buffer fluid will remain in the annular space as the tubing is coated with silicate foam it is preferred that the buffer fluid have a higher boiling point than the silicate solution.

The buffer fluids employed in the practice of this invention may include any fluid which can buffer the packer and the lower portion of the tubing from the silicate solution during the boiling and heating operations. Preferably, the buffer fluid has a higher density than the density of the silicate solution so that the buffer fluid will tend to reside in the lower portion of the annular space. It should be understood, however, that the density of the buffer fluid may be equal to or less than the density of the silicate solution. For example, buffer fluids having a density less than the silicate solution's density may be introduced into the lower annular space and the boiling and heating operations performed before the buffer fluid has been substantially displaced by the more dense silicate solution. Since the buffer fluid contacts the silicate solution, the buffer fluid should be chemically compatible with the silicate solution and should not cause excessive precipitation or complexing of the dissolved solids in the silicate solution. The buffer fluid should also not be excessively corrosive to the casing or tubing in the formation and should be readily available and economical. By way of example, the materials listed below in Table 1 have properties suitable for displacing sodium silicate in such an insulation process.

TABLE 1

| | Sp. Gr. | B.P. at 1 Atm. |
|---|---|---|
| Tetrachloroethylene | 1.619 | 121 – 123° C |
| 1,1,2 Trichloroethane | 1.443 | 110 – 115° C |
| Trichlorobenzene | 1.454 | 214 – 219° C |

The silicates employed in the practice of this invention are those of the alkali metals which readily dissolve in water. This group is commonly termed the soluble silicates and includes any of the silicates of the alkali metals, with the exception of lithium. However, in the practice of this invention, it is preferred to employ silicate solutions containing sodium or potassium as the alkali metal, due to the relatively low cost and ready commercial availability of such solutions.

When water is removed from the solutions of the soluble silicates, they crystalize to form glass-like materials. When the soluble silicates are dried rapidly at boiling temperatures, the solutions intumesce and form a solid mass of bubbles having 30–100 times their original volume. The dried foam is a ligh weight glassy material having excellent structural and insulating properties.

In the practice of this invention, commercially available sodium silicate solutions have been found suitable. Such solutions have a density of approximately 40° Be. at 20° C. and a silica dioxide/sodium oxide weight ratio of approximately 3.2/1. Alternatively, commercially available potassium silicate solutions may be employed. Commercial potassium silicate solutions have a density of approximately 30° Be. at 20° C. and a silica dioxide/-potassium oxide weight ratio of approximately 2.4/1. The silica dioxide/alkali metal oxide weight ratio is not critical to the practice of this invention and may range between 1.3/1 and 5.0/1. The density of the solutions may range between 22° Be. and 50° Be. at 20° C. It is only important that sufficient solids be contained in the solution so that upon boiling a coating of approximately one-eighth of an inch or greater will be deposited upon the tubing string.

In some instances, particularly in wells of extreme depths, it may not be possible to remove all of the silicate solution within the annular space by boiling.

The foam may build up at a rapid rate on the tubing and insulate the annular space so effectively that the temperature of the liquid remaining in the annular space drops below its boiling point. In the practice of this invention, this problem may be alleviated to some extent if the buffer fluid also boils during the heating operation. However, if excess silicate solution remains in the annular space above the buffer fluid it may be displaced from the annular space by injecting any suitable liquid, including the buffer fluid, down the tubing, through the gas-lift mandrel, and up the annulus. It should be recognized, however, that circulation could be performed in a reverse manner with the displacing liquid introduced down the annulus and up the tubing. In either event, prior to injecting this displacing liquid, the blanking plug is installed at the landing nipple in the tubing and the dummy valve is pulled from the gas-lift mandrel. With the blanking plug installed and the dummy valve removed, fluid communication will be established between the interior of the tubing and the annulus.

The quantity of displacing liquid introduced into the well to displace excess silicate solution and buffer fluid should be equal to or in excess of the volume of casing-tubing annulus. Preferably, at least one and one-half times the annular volume is introduced to insure substantially complete removal of the silicate solution. Following displacement of the excess silicate solution the displacing liquid is removed in any convenient manner such as gas-lifting or swabbing the tubing. Finally, the annulus may be further dehydrated by injecting further quantities of steam down the tubing string and into the oil-bearing formation. This additional steaming will aid in removing any minor quantities of silicate solution remaining in the annular space.

The compounds listed in Table I are effective for displacing the excess silicate solution since they have a low solubility for the silicate coating and have a higher density than silicate solution. These liquids, therefore, should displace excess silicate solution and not have any substantial adverse effect on the insulating properties of the silicate coating.

The principle of the invention and the manner in which it is contemplated to apply that principle have been described. It is to be understood that the foregoing is illustrative only and that other means and techniques can be employed without departing from the true scope of the invention as defined in the following claims.

What I claim is:

1. A process for thermally insulating a tubing string suspended within a wellbore which comprises:

injecting into the wellbore-tubing string annular space an aqueous solution containing water-soluble silicate, injecting into the wellbore-tubing string annular space a fluid substantially free of silicate to buffer a portion of the tubing from the silicate solution, introducing thermal energy into the tubing string to remove water from the silicate solution and to deposit a coating of silicate on the tubing.

2. A process as defined in claim 1 wherein the substantially silicate-free fluid has a higher density than the silicate solution.

3. A process as defined in claim 2 wherein the substantially silicate-free fluid has a higher boiling point than the silicate solution.

4. The process as defined in claim 1 wherein the substantially silicate-free fluid is injected into the annular space prior to injecting said silicate solution into the annular space.

5. The process as defined in claim 1 wherein the substantially silicate-free fluid and the silicate solution are injected simultaneously into the annular space.

6. The process as defined in claim 1 wherein the substantially silicate-free fluid is injected into the annular space after injecting the silicate solution into the annular space.

7. A process as defined in claim 1 wherein a substantial portion of the substantially silicate-free fluid injected into the annular space is below the silicate solution.

8. A process as defined in claim 1 wherein the substantially silicate-free fluid injected into the annular space is between a packer disposed upon said tubing string and the silicate solution.

9. A process as defined in claim 1 wherein the substantially silicate-free fluid injected into the annular space is disposed in the lower portion of the annular space as thermal energy is introduced into the tubing string.

10. A well operation for a well containing a tubing string suspended within a casing string and containing a packer disposed upon said tubing string and in contact with said casing string to seal the casing-tubing annular space above an oil-bearing formation which is penetrated by said well which comprises filling at least a portion of the annulus above said packer with a aqueous solution containing water-soluble silicate, injecting a fluid substantially free of silicate into the annular space to buffer a portion of the tubing from the silicate solution, injecting steam down the tubing and into the formation to boil the silicate solution and to deposit a coating of silicate foam on the exterior of the tubing.

11. The method as defined in claim 10 wherein the process further comprises venting the annulus to discharge water vapor removed from the solution and to discharge excess silicate solution from the annulus, and removing oil from the formation.

12. The method as defined in claim 10 wherein the substantially silicate-free fluid injected into the annulus is disposed between the packer and the silicate solution.

* * * * *